US007913695B1

(12) United States Patent
Moore et al.

(10) Patent No.: US 7,913,695 B1
(45) Date of Patent: Mar. 29, 2011

(54) MOUTH GUARD WITH FIXED TETHER SYSTEM

(76) Inventors: John J. Moore, Newtown Square, PA (US); Timothy Moore, Springfield, PA (US)

( * ) Notice: Subject to any disclaimer, the term of this patent is extended or adjusted under 35 U.S.C. 154(b) by 53 days.

(21) Appl. No.: 11/901,912

(22) Filed: Sep. 19, 2007

Related U.S. Application Data

(60) Provisional application No. 60/845,612, filed on Sep. 19, 2006.

(51) Int. Cl.

| | |
|---|---|
| ***A61C 5/14*** | (2006.01) |
| ***A42B 3/00*** | (2006.01) |
| ***A42B 1/24*** | (2006.01) |
| ***A63B 71/10*** | (2006.01) |

(52) U.S. Cl. ..... 128/861; 128/862; 2/6.2; 2/422; 2/425

(58) Field of Classification Search ..... 128/861, 128/862; 2/6.2, 422, 425
See application file for complete search history.

(56) References Cited

U.S. PATENT DOCUMENTS

| | | | | |
|---|---|---|---|---|
| 3,407,809 | A * | 10/1968 | Ross | 128/861 |
| 3,485,242 | A * | 12/1969 | Greenberg | 128/862 |
| 4,791,941 | A * | 12/1988 | Schaefer | 128/861 |
| 5,365,946 | A * | 11/1994 | McMillan | 128/861 |
| 5,732,715 | A * | 3/1998 | Jacobs et al. | 128/861 |
| 5,941,246 | A * | 8/1999 | Roopchand | 128/207.14 |
| 6,941,952 | B1 * | 9/2005 | Rush, III | 128/861 |
| 7,353,828 | B1 * | 4/2008 | Hirshberg | 128/861 |
| 7,462,132 | B2 * | 12/2008 | Kuehne | 482/11 |
| 2005/0028827 | A1 * | 2/2005 | Halstrom | 128/861 |

* cited by examiner

*Primary Examiner* — Patricia M Bianco
*Assistant Examiner* — Victoria Hicks
(74) *Attorney, Agent, or Firm* — Robert B. Famiglio, Esquire; Famiglio & Associates

(57) ABSTRACT

An improved mouth guard designed for use with protective equipment such as helmets and other head gear is disclosed. The invention provides a convenient means to temporarily affix the mouth guard to sports equipment, or other object when the mouth guard is removed, rather than using a conventional or traditional tethering strap. The disclosed mouth guard can be quickly removed from a user's mouth and quickly attached to a helmet component, player's finger, or other piece of equipment to allow the mouth guard to remain rigidly affixed to the player without a loose tethering strap such as used in conventional mouth guards. The invention also is applicable to other mouth guard devices which may be used for dental treatment applications to secure a dental appliance temporarily when removed from the user's mouth.

3 Claims, 3 Drawing Sheets

MOUTH GUARD WITH FIXED TETHER SYSTEM

CROSS REFERENCE TO RELATED APPLICATIONS

The Applicants claim the benefit of their provisional application No. 60/845,612 filed on Sep. 19, 2006.

BACKGROUND OF THE INVENTION

1. Field of the Invention

The present invention relates to means to rigidly tether a sports mouth guard to a face shield or finger to avoid handling the mouth piece during non-use.

2. Description of the Related Art

Protective mouth pieces are used in combination with a protective helmet or other protective headgear during the play of many different sports. The invention may also relate to dental appliances used in medical care such as retainers or temporary braces. The present invention relates specifically to a means to temporarily but rapidly affix and then remove protective mouth gear to the user's equipment or the player's finger to allow the mouth piece to be quickly redeployed after the guard is removed from the user's mouth.

Mouth guards are commonly used in most sports where the participants may be exposed to injury or other harm as a result of the participation in the sport. Mouth guards are also used as dental appliances in some applications such as dental retainers or temporary braces worn by users during sleep. In certain contact sports, physical harm is likely where the athletic event involved provides for collision between participants. Such sports include, for example, football, ice hockey, soccer, lacrosse and other contact sports where deliberate collisions between the players are common. Said sports employ various types of protective equipment including mouth guards to reduce teeth and mouth injuries during collisions. Mouth guards for such sports are soft, pliable coverings which are worn in the mouth and protect the teeth from injury during physical contact during the play of the game. Mouth guards have been in use for many years and are used in various different contact sports as mentioned above.

In most sports in which mouth guards are deployed there are also helmets used to protect from head injury. In between actual plays in various contact sports, users of mouth guards frequently remove the guards because they are uncomfortable if they remain in place after long periods of time. In watching a typical football game in the United States, spectators often see a mouth guard being removed or expelled from a player's mouth between plays and held in the player's hand until ready to be used again. Players find the need to hold onto the mouth guard inconvenient as they prefer to have both hands free and handling the mouth guard exposes it to dirt and grime which can build up. When this happens the player needs to rinse or sterilize the mouth guard, as the case may be. The same issue arises when a dental or medical device is temporarily removed from a user's mouth.

In the past, this particular inconvenience has been addressed by having free tethers attached to the front of the mouth guard on a tab. Such mouth guards allowed the player to release the mouth guard through a spitting action, expelling the mouth guard from the player's mouth and face area but allowing the guard to be held by the face guard on a typical helmet such as one finds in the play of the game of football. Such tethering wraps around any structural element of the helmet, a face guard being preferred, thereby stopping the movement of the mouth guard and allowing the guard to hang, free of the need for the player to handle the mouth guard.

It is also true that many tethering systems have been deployed to retain a sports mouth guard by attachment to the helmet or face shield of protective equipment. Such known tethering means rely on strap-like attachments which allow the expelled guard to dangle loosely from the sports equipment member to which they are tethered. The loosely tethered mouth guards seem to be disfavored by players as the guard swings to and fro with head movement and other motion. For this reason many players simply place the guard in their hands until the next play.

Players seem to prefer not to have a loose, dangling mouth guard tethered to their helmet or other piece of protective play equipment. Many times the loose movement of the mouth guard, when not solidly tethered, is annoying or uncomfortable for some players and therefore they continue to take the mouth piece out with their hand as they choose not to deploy a loose tethering means such as a tab or extended plastic wrap, velcro or the like. Prior art does not provide a more convenient means to affix a sports mouth guard to a player's equipment or a player's finger with a rigid means to prevent the mouth piece from dangling or moving loosely around a tethered point from when the player moves.

The very same advantages observed by the use of the invention with sports equipment is realized by applying the same embodiments with a dental appliance such as temporary braces or a retainer worn by a patient while sleeping. Many times users will remove the move guard or similar dental appliance during the night to take a drink, speak on the phone or for whatever reason it is necessary to remove the device from one's mouth. Rather than placing it on a table or within a sterile container, many find it convenient to place the appliance in their hand temporarily. It would be useful to have a simple, inexpensive means to attach a temporary dental appliance to a fixed object, a finger, the end of a toothbrush or some other convenient place to allow the retainer or dental appliance to be suspended firmly in the air away from contaminating substances or surfaces.

SUMMARY OF THE INVENTION

The invention is a mouth guard including a rigid inline tether assembly which comprises a forward extending, tether-connecting, fixed position tab extending from an anterior portion of the mouth guard. The anterior extending portion has a forward end terminating in a semi-flexible but fixed clamp or affixing means adapted to hold the mouth guard to an external feature of the user's sports equipment or other external surface, such as a helmet face mask or finger. A fastener or clamping means snaps onto a structural member of a face plate or the player's finger by friction fit. The fastener clamp is rigidly attached to the mouth piece to prevent significant movement of the mouth guard when the fastener is in use. In alternative embodiments, the connector element is modified to particularly affix more readily to a stem-shaped face shield member, a player's finger, or other structural components commonly found in protective gear used by players engaged in physical contact sports requiring mouth guards. The disclosed means allows the mouth guard to stand off from any equipment and be supported in free air until retrieved.

In response to the observed need for a more convenient means to affix a sports mouth guard to a player or the player's equipment between use, the present invention presents an improved means to attach a mouth guard to a player's equipment, uniform or body for stowing the mouth guard between use and between plays of a contact sport game. The mouth piece assembly includes a mouth guard. The mouth guard is generally U-shaped to receive the upper and lower set of a player's teeth in a conventional fashion. The mouth guard includes a rigid inline tether assembly to attach the mouth guard to an external point used to stow the mouth guard temporarily when removed from the player's mouth. The invention is also directly applicable as a means to store a medical mouth guard temporarily on an external surface.

A principle object and advantage of the present invention is to properly and firmly support a mouth guard in a convenient location after being removed from a user's mouth while allowing the mouth guard to remain relatively clean and be immediately ready to deploy when a user needs the guard to be placed back in use. Such a rigid and rapid attachment means encourages a player to stow the mouth guard as opposed to handling the equipment and potentially contaminating it before placing the mouth guard back into the player's mouth.

Another object and advantage of the present invention is that the mouth guard and tether assembly is provided such that the clamping means at the end of the tether element opposite the mouth piece is firm, yet flexible enough to conform to a variety of different sized or diameter structural elements such as a helmet or player's finger.

Yet another object and advantage of the present mouth guard tether assembly is that is it relatively stiff and prohibits the mouth guard portion from excessive movement when a player affixes the guard to himself or to his equipment.

DETAILED DESCRIPTION OF THE INVENTION

Figure 1:
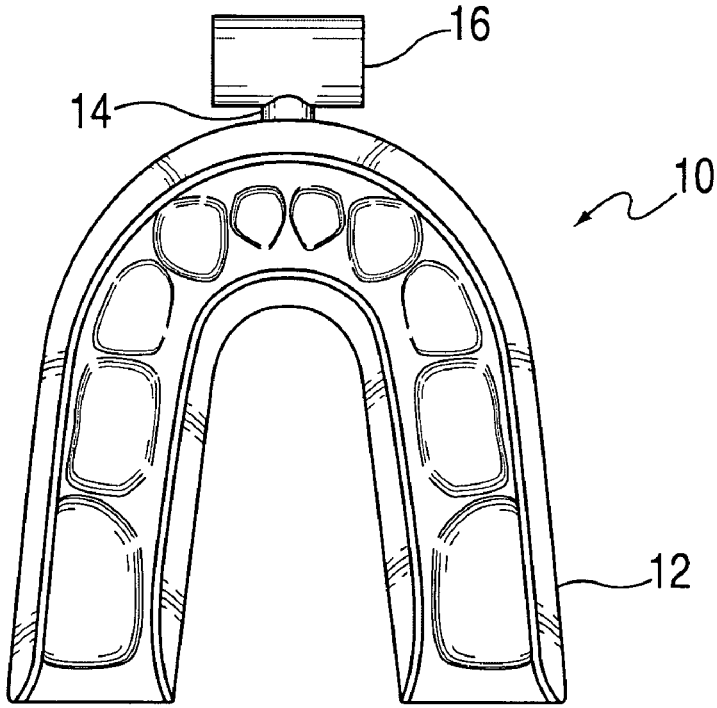
FIG. 1 is a top plan view of the invention showing the details of the mouth guard, tethering section and clamping means as described in the specification.

Now the invention will be described in detail with reference to the various figures wherein like numerals refer to like parts. Turning to FIG. 1, mouth guard 10 is shown in a plan view where each of the structural components which comprise the whole of the invention are illustrated. Mouth guard 10 is comprised of a U-shaped, teeth guard portion 12, which fits snugly within the player's mouth as the mouth guard is deployed. As is known to those skilled in the art of mouth guards, mouth guard portion 12 is comprised of soft, pliable material, such as to snugly fit about the teeth of a player to provide additional protection in contact sports. Mouth guard portion 12 is attached either directly to clamp 16 or, if desired to provide a slight standoff, through rigid connector 14. Connector 14 is a semi-rigid structural element which provides support for guard portion 12 when mouth guard 10 is snapped in place temporarily to hold mouth guard 10 in a position when the user removes guard 10 from the mouth. The preferred embodiment is simpler to manufacture if clamp 16 is molded directly onto the surface of mouth guard portion 12. Connector 14 is not necessary to enjoy the benefits of the invention, as the stand-off created by this element is a matter of preference. If used, it should be made of sufficient stiffness or rigidity to prevent the mouth guard portion from excess movement. An advantage of utilizing the short stand-off provided by connector 14 is to allow clearance of clamp 16 by providing stand-off distance from the anterior portion of mouth guard 12. As can be appreciated by the figures, connector 14, if used, does provide for clearance to allow a user's lips to clear the distance between clamp 16 and mouth guard 12 as can be appreciated by observing FIG. 1 and FIG. 2. Sometimes this provides for a more comfortable fit depending on the user.

Clamp 16, as shown in FIG. 1, is likewise a semi-rigid yet pliable material which allows movement of the arms of clamp 16 when it is pressed against a rod-like structural element such as a component of a football helmet face shield or a even a player's finger to temporarily hold the mouth guard after it has been removed from use. All of the structural elements of the invention, particularly connector 14 and clamp 16 are firm, yet pliable to provide a measure of protection to the user if any such element is struck by an external force while guard 10 is in the user's mouth.

Figure 2:
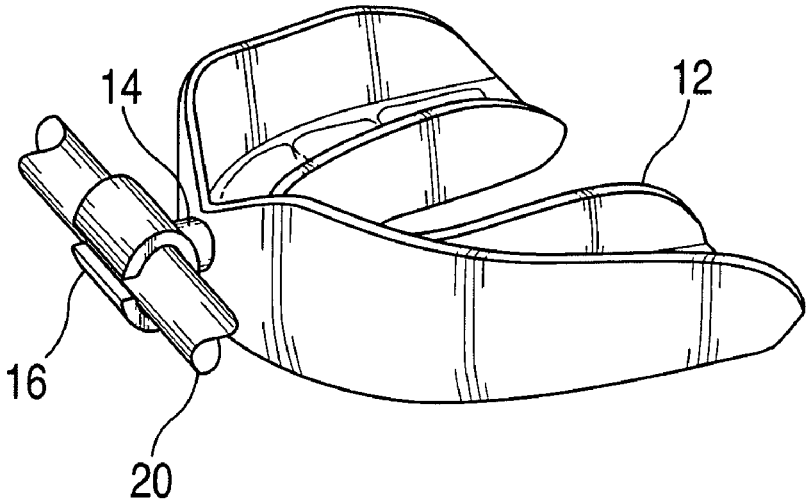
FIG. 2 is a perspective view representation of the mouth guard stowed temporarily on a structural element such as found on a helmet face shield between deployment of the mouth guard.

FIG. 2 illustrates mouth guard 10 snapped in place on structural element 20. It can be appreciated by review of FIG. 2 that clamp 16 snaps around the circumference of structural element 20 which is, most often, a rod or cylinder-like component of a helmet face shield. If desired, clamp 16 will also fit and snugly affix to a player's finger such as to allow the mouth guard 10 to be suspended in free space rather than require guard 10 to be placed in a player's hand or placed in a pocket or suspended in a less sanitary fashion.

Connector 14 or clamp 16 are fashioned from suitable materials such as nylon, vinyl, plastic, or rubber. Material used for connector 14 is stiff and relatively inflexible so that it will remain largely in line and not twist or be overly flexible. It has been determined that the invention disclosed functions most conveniently when connector 14 allows some flexibility but is relatively stiff so that the U-shaped guard portion 12 can be adequately supported without undue drooping or vibration when the user moves. It also should be understood that clamp 16 is a structure which functions by separating slightly as pressure is brought to bear on clamp 16 to allow a structural component to snap into place within the interior position of clamp 16. The thickness and flexible of clamp 16 is chosen for its ability to support mouth guard 12 when in place and yet be pliable enough to allow the jaws of clamp 16 to spread slightly as clamp 16 is pressed firmly onto a structure to hold the entire mouth guard 10 firmly on the structure until ready to be removed.

By the arrangement illustrated, mouth guard 10 can be released quickly from its affixed position on structural element 20. While mounted externally on a user's finger or face piece guard element, mouth guard 10 can be quickly redeployed as it is maintained or oriented at a location suspended in free air available to be quickly grasped and inserted in the user's mouth when needed.

The essence of the present invention is the improvement in the means used to affix the mouth guard to an external storage point. As can be seen by the various embodiments depicted in the figures, the invention can be carried out by configuring clamp 16 of the embodiment in FIGS. 1 and 2 using different shapes of extensions or materials which can grasp or lock onto a position on any external element that will allow the mouth guard to rest in place.

Figure 3:
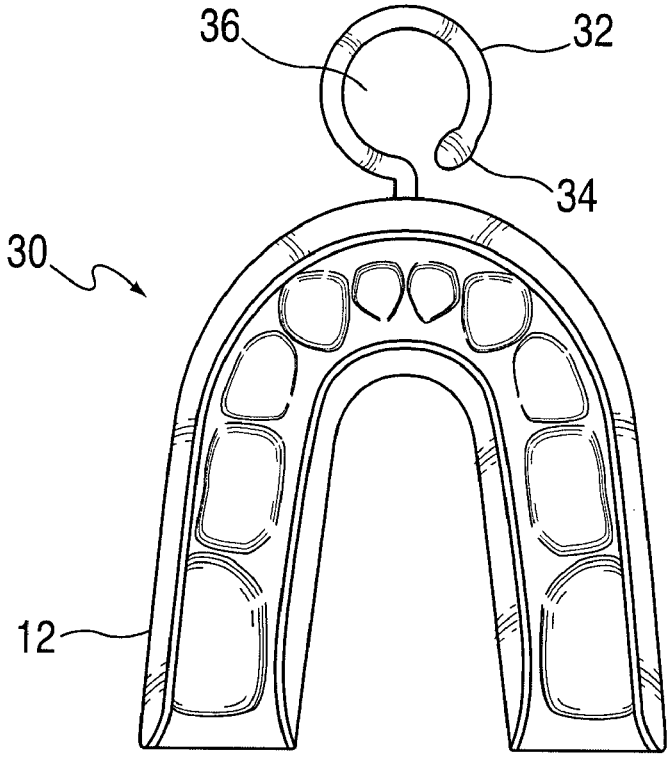
FIG. 3 is a top plan view of the mouth guard showing an alternative loop style connector more suitable for finger attachment.
Figure 4:
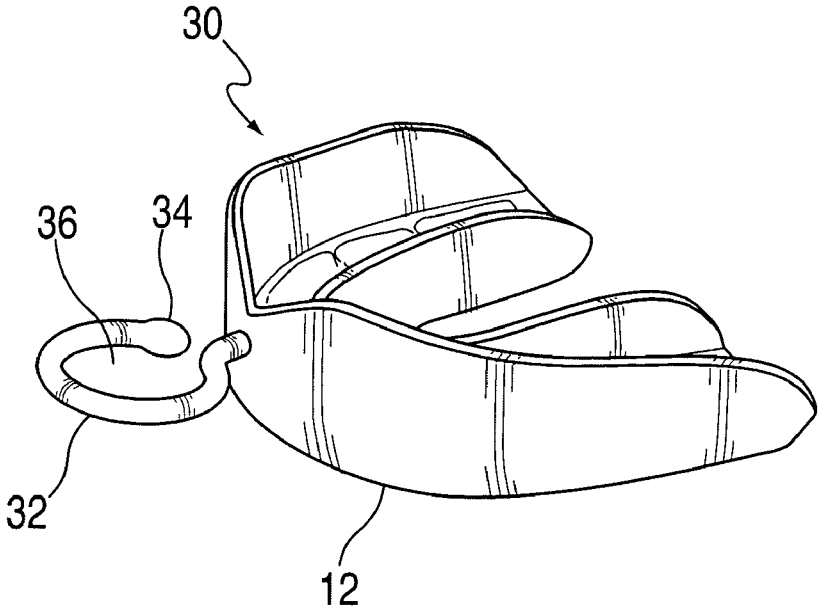
FIG. 4 is a perspective view of the embodiment shown in FIG. 3.

One alternate embodiment is shown in FIG. 3. This embodiment depicts mouth guard 30 with clamp 32 as a continuous element molded to be rigid in a looped shape thereby allowing clamp 32 to snap around an external structural element 20 or a player's finger inserted into area 36 to hold guard portion 12 in place. FIG. 4 shows a side view of the embodiment shown in FIG. 3 which illustrates a lower side profile for clamp 32 in this embodiment. An enlargement or swelled end 34 adds additional friction to the removal process providing security such that the alternate embodiment shown at 30 will only allow removal from the player's finger when desired.

Figure 5:
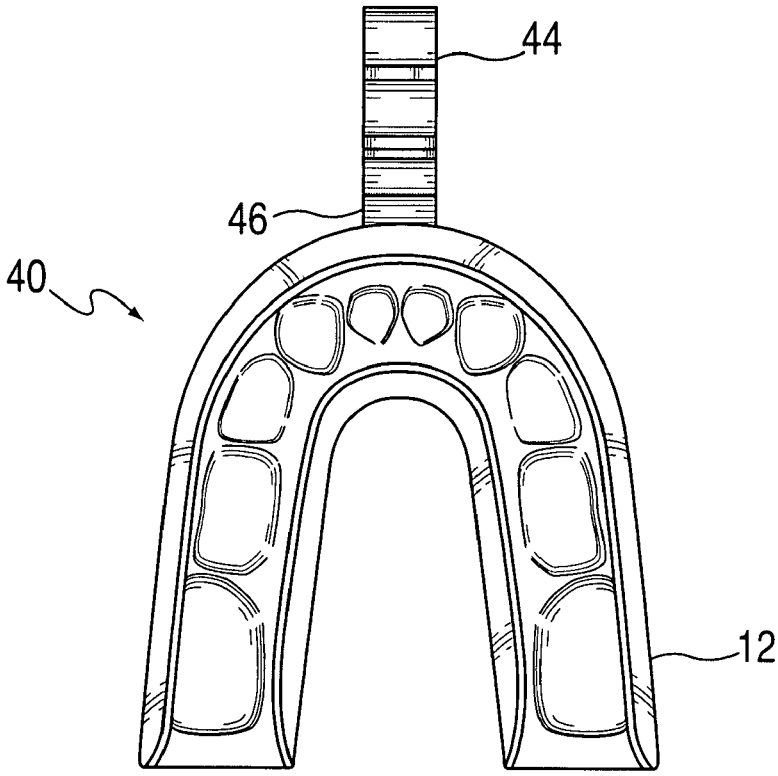
FIG. 5 is a top plan view of an alternate embodiment of the mouth guard using an alternative attachment connector.
Figure 6:
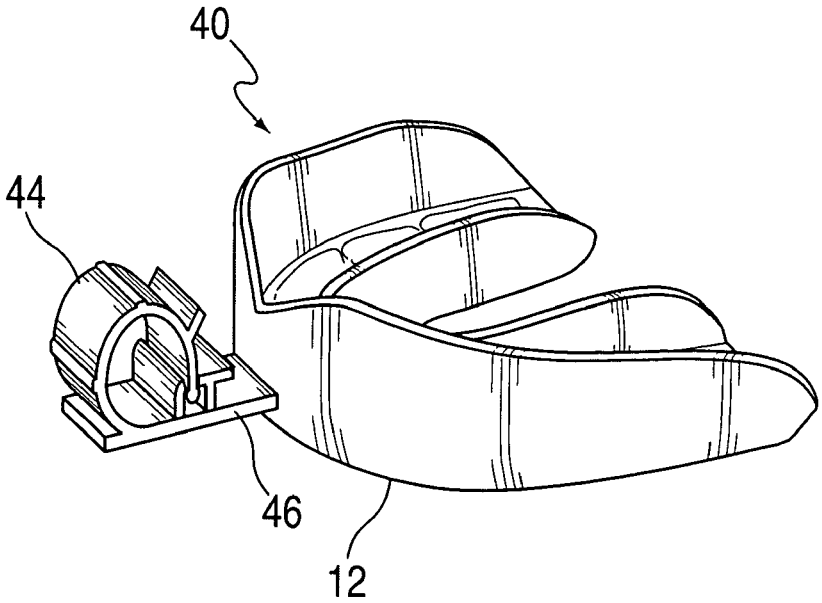
FIG. 6 is the perspective view of the embodiment shown in FIG. 5.

FIG. 5 and FIG. 6 are depictions of an alternative configuration of mouth guard 40 whereby clamp 44 is of a more complex geometry providing additional clamping action to any member inserted through clamp 44. In some instances, embodiment 40 may hold an advantage depending on the molding technique used and the rigidity of clamp 44. Similar to the attachment means of the other embodiments, clamp 44 is attached to guard portion 12 through connector 46 which can be short or extended slightly if greater stand-off is desired.

The embodiments shown in FIG. 5 and FIG. 6 allow a locking mechanism to be employed as shown specifically by the perspective view of clamp 44 illustrated in FIG. 6. In some instances, positive latching may be desired when clamping the entire mouth guard 40 onto a structure to be held until retrieved. By utilizing the configuration of clamp 44 it can be appreciated that the clamp uses a friction snap-in fit similar to cable clamps which are used to allow affixing electrical cables to the side of a cabinet while being releaseable to remove those cables from time to time as desired.

Although the description of the preferred embodiment has been specific with respect to a particular shape and design, it is contemplated that various modifications could be made without deviating from the spirit of the invention. Utility of the invention described is comprised in the use of a fixed tethering position offered by clamp 16 in the first embodiment disclosed as opposed to a flexible strap used in conventional technology which allows the mouth guard to hang from a structural element upon which it may be strapped. The improvement is realized, among other things, through the ability to firmly affix mouth guard 10 to a desired location on a component of sports equipment and have it firmly suspended in free air rather than loosely attached through a conventional flexible strapping means.

Also, it should be evident from the figures that integration of clamp 16 directly to mouth guard portion 12 is possible such as to simplify the structure of this invention. In doing so, connector 14 may be eliminated without loss of the advantages of the invention. Connector 14 is used to provide spacing between the attachment point clamp 16 and the mouth guard portion 12 in such applications where stand-off between the two elements is desirable. The other embodiments, mouth guard 30 and mouth guard 40 also offer the same advantage while providing flexibility as to technique to stow the assembly.

The invention is also useful in applications for dental guards and related appliances for medical purposes. A dental retainer or mouth guard may be attached to the end of a tooth brush or other common object for temporary placement. Such applications of this invention function the same as the embodiment described for use in sports equipment.

The invention has been described in various different embodiments, but there will be adjustments and modifications that become apparent to those skilled in the art once studying the enclosure and the included sketches used to explain the invention. Each of the variations which may be apparent from this disclosure are also claimed to be within the scope of the invention.

What is claimed is:

1. A mouth guard assembly for insertion into a wearer's mouth to protect the wearer's teeth comprising:

a generally curved mouth portion for insertion in the wearer's mouth; and, an attachment means to temporarily attach said mouth portion to an attachment point, the attachment means including a loop attached to and protruding distally away from the anterior of the mouth guard;

wherein further said loop is comprised of a short shaft configured to protrude outwardly from the wearer sufficient to clear the wearer's mouth when the mouth guard assembly is in use by the wearer, said short shaft curving into an open-end loop, said open-end loop having an opening between an end of said short shaft loop and the attachment point of the said loop to the mouth portion.

2. The mouth guard assembly of claim 1 wherein further said short shaft is configured to protrude outwardly from the wearer's mouth.

3. A mouth guard assembly for insertion into a wearer's mouth to protect the wearer's teeth comprising:

a generally curved mouth portion for insertion in the wearer's mouth; and, an attachment means to temporarily attach said mouth portion to an attachment point, the attachment means attached to and protruding distally away from the anterior of the mouth guard;

wherein further said attachment means is comprised of a short shaft configured to protrude outwardly from the wearer sufficient to clear the wearer's mouth when the mouth guard assembly is in use by the wearer, said short shaft terminating in a connecting means having an opening to connect onto the attachment point.

* * * * *